United States Patent [19]

Koch

[11] 4,334,595

[45] Jun. 15, 1982

[54] FALL PREVENTING DEVICES

[76] Inventor: Albert Koch, Doux Sejour, 67860 Lutzelhouse (Bas-Rhin), France

[21] Appl. No.: 188,534

[22] Filed: Sep. 18, 1980

[30] Foreign Application Priority Data

Jan. 10, 1979 [FR] France ..... 79 25271

[51] Int. Cl.[3] ..... A62B 1/14; A63B 27/00

[52] U.S. Cl. ..... 182/5; 188/65.2; 24/134 N

[58] Field of Search ..... 182/3, 5, 6, 7; 188/65.2, 65.4, 65.1; 24/134 L, 134 N, 132 R

[56] References Cited

U.S. PATENT DOCUMENTS

| | | | |
|---|---|---|---|
| 2,034,841 | 3/1936 | Staggers | 188/65.2 |
| 2,157,639 | 5/1939 | Staggers | 188/65.2 |
| 3,702,689 | 11/1972 | Zeller | 24/134 N |
| 3,916,487 | 11/1975 | Rinio | 24/134 N |
| 3,926,278 | 12/1975 | Molnar | 182/7 |
| 3,941,354 | 3/1976 | Paige | 24/132 R |

FOREIGN PATENT DOCUMENTS

| | | | |
|---|---|---|---|
| 1169819 | 5/1964 | Fed. Rep. of Germany | 182/5 |
| 1243059 | 8/1960 | France . | |
| 1597633 | 8/1970 | France . | |
| 2370151 | 6/1978 | France . | |

*Primary Examiner*—Reinaldo P. Machado
*Attorney, Agent, or Firm*—Young & Thompson

[57] ABSTRACT

An instantaneously acting fall preventing device comprises a casing containing a locking mechanism, in the form of a series of rings which are adapted to co-operate with a retaining cord, and a connecting element for attachment to a harness or safety belt. The upper ring of the series of rings is provided with a lever which passes through a wall of the casing and extends into a guidance member for the connecting element. When the device is in the unlocked position, the lever is held against an abutment in the guidance member and said lever moves away from the abutment in the event of a fall to permit the rings to engage the cord and lock the device.

2 Claims, 1 Drawing Figure

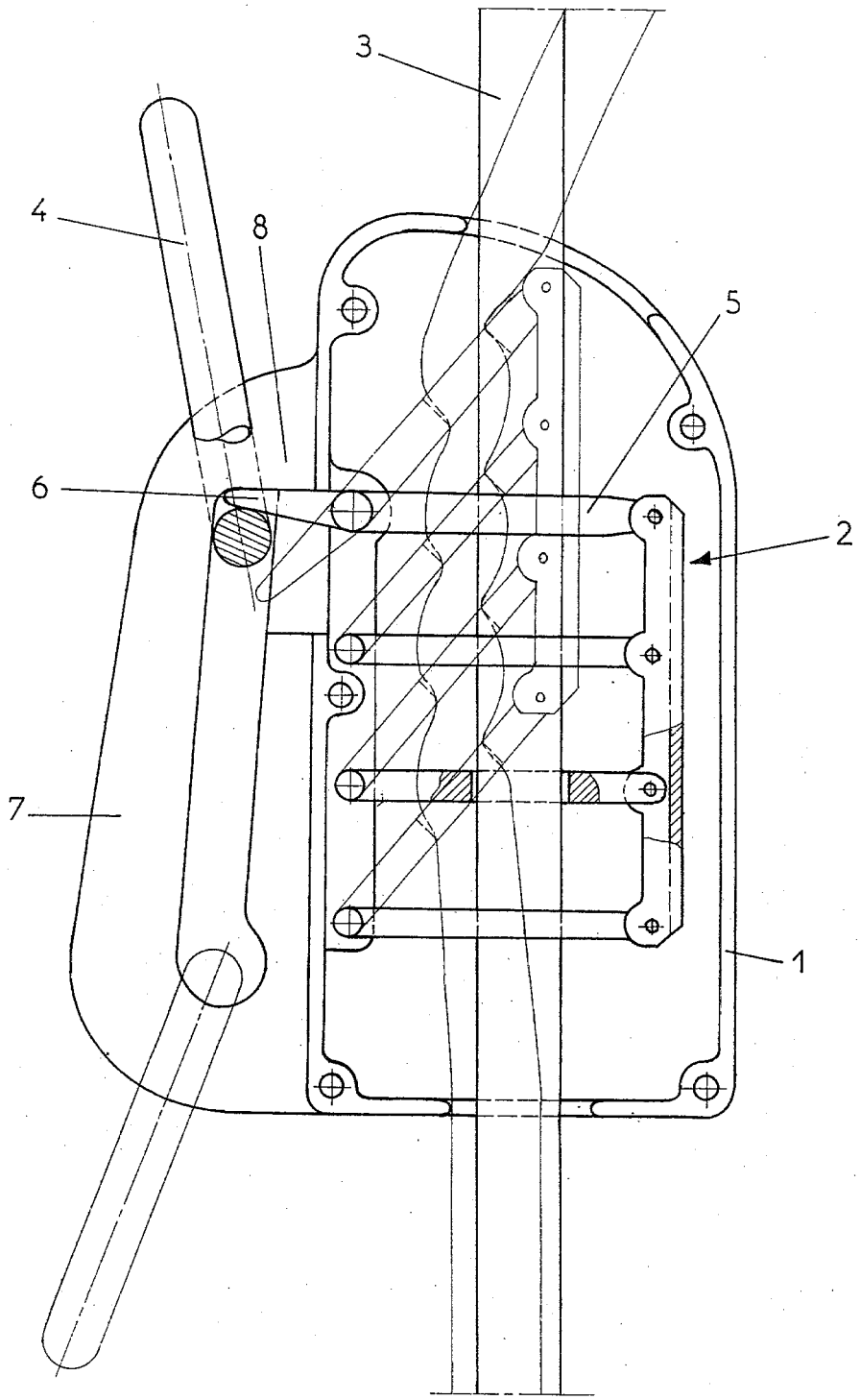
3
4
8
5
6
2
7
1

FALL PREVENTING DEVICES

BACKGROUND OF THE INVENTION

The present invention relates to the protection of workers exposed to the risk of falling from considerable heights, more particularly in the building industry, and specifically relates to a fall preventing device having an instantaneous locking action.

Known fall preventing devices are generally constituted by a locking mechanism which is fixed to a member for connection to a harness or belt worn by the user by means of a connecting element, said mechanism co-operating with a retaining cord, rope or cable. These known devices are often provided with an unlocking push button operated by the user when he is moving at points a long way from the connecting point.

The known fall preventing devices are very reliable and they have a very short response time in the case of a fall. However, if the user operates the unlocking push button in order to carry out movements away from the connection point, his safety is compromised since at these times he is not protected. In addition, since the push button is readily accessible and easy to operate, there is a risk of an untimely operation of said push button by a reflex movement by the user's hand in the case of a fall or when he is unbalanced.

There are also fall preventing devices in which the manual unlocking push button is duplicated by an automatic locking mechanism. However, the known automatic devices in which unlocking is brought about by the action of a return spring have a certain inertia and as a result there is a relatively long length of fall, followed by sudden deceleration which can cause a painful shock or injury to the user's body.

SUMMARY OF THE INVENTION

The object of the present invention is to obviate these disadvantages by reducing the length of fall to a negligible value.

Accordingly, one aspect of the invention provides a fall preventing device with an instantaneous locking action, essentially constituted by a box or a case containing a locking mechanism in the form of a series of rings, which co-operates with a retaining cord, and by an attachment member of the box to a harness or to a safety belt, wherein the upper ring of the series of rings is extended by a lever traversing the wall of the box and issuing outside the same into the upper part of a member guiding the connecting element. When the device is in the unlocked position, this lever is inserted between the upper part of the guidance member and the lower part of the connecting element and maintains this position due to the weight exerted by the fall preventing device. This weight ceases instantaneously in the case of a fall and the braking action follows immediately.

Another aspect of the invention provides an instantaneously acting fall preventing device comprising a casing having a wall containing an aperture and a guidance member mounted on said wall outside of said casing; a locking mechanism located in said casing and arranged to co-operate with a retaining cord passing through said casing, said locking mechanism comprising a series of rings surrounding part of the length of said cord; a lever extending from an end one of said series of rings through the aperture in said casing wall into said guidance member; an abutment in said guidance member and a connecting element mounted in said guidance member and adapted to be attached to a harness or safety belt; said connecting element serving to maintain the lever against the abutment in said guidance member in the normal unlocked position of the device and to permit said lever to move away from said abutment so as to actuate the locking mechanism in the event of locking of the device being required.

BRIEF DESCRIPTION OF THE DRAWING

The invention will be better understood from the following description relating to a preferred, but non-limitative embodiment and explained with reference to the attached diagrammatic drawing, which is a plan view of one embodiment of a fall preventing device according to the invention, in which one of the side walls has been removed to reveal the internal components.

DESCRIPTION OF PREFERRED EMBODIMENT

The fall preventing device having an instantaneous locking action shown in the drawing is constituted by a box or casing 1 in which is provided a locking mechanism 2 in the form of a series of rings co-operating with a retaining cord 3 and by a connecting element 4 attached to a harness or safety belt. According to the invention, the upper ring 5 of the series of rings is provided with a lever 6, which traverses the wall of the box 1 on the side of the ring axes and issues into a space defined by a guidance member 7 of the connecting element 4. When the locking mechanism 2 is in the unlocked position, i.e. the position in which the cord 3 can slide freely, the lever 6 engages with an abutment 8, provided for this purpose at the internal upper end of the guidance member 7, in such a way that any downward pivoting of the chain of rings is prevented.

The fall preventing device according to the invention functions in the following way. When the user attaches the device to his harness or safety belt it exerts a weight in such a way that the connecting element 4 maintains the lever 6 against the abutment 8 provided within the member 7. As a result of the action of the connecting element 4 on the lever 6, the series of rings of the locking mechanism is maintained in the unlocking position of the cord 3 in such a way that the user can move freely either away from or towards the connection point. If the user is off-balanced and falls, the connecting element 4 moves towards the bottom of the box 1 and member 7 thereby freeing the lever 6 which instantaneously pivots together with the series of rings into the locking position of the cord 3, due to the tightening action exerted by the rings. The movement of the connecting element 4 in the guidance member 7 results from the harness or safety belt worn by the user dragging the said connecting element and consequently the entire weight thereof acts on the member 7 and consequently on the box 1, so that the cord 3 is locked by tightening (position shown by fine lines in the drawing).

If during a movement the mechanism instantaneously locks the cord 3, the user can immediately bring about unlocking by lifting the box 1 slightly, so that the series of rings is returned to the horizontal position.

As a result of the invention and particularly the arrangement of the lever 6, it is possible to ensure an instantaneous locking of the fall preventing device, thus preventing a rash actuation of the lever due to panic.

Obviously, the invention is not limited to the embodiment described and shown in the drawing. Numerous modifications are possible, particularly with regard to the construction of the various elements, or by substituting technical equivalents without departing from the scope of the invention as defined by the appended claims.

I claim:

1. An instantaneously acting fall preventing device, essentially comprising a box containing a locking mechanism in the form of a series of rings, said mechanism being adapted to co-operate with a retaining cord, and a connecting element adapted to attach said box to a harness or safety belt, wherein a ring at one end of said series of rings is provided with a lever which passes through a wall of said box and passes out beyond said wall into a guidance member for the connecting element and when the device is in the unlocked position this lever is applied against an abutment within the guidance member and moves away from this abutment when the cord is in the locked position in the case of a fall by cancelling out the weight action of the device.

2. An instantaneously acting fall preventing device comprising a casing having a wall containing an aperture and a guidance member mounted on said wall outside of said casing; a locking mechanism located in said casing and arranged to co-operate with a retaining cord passing through said casing, said locking mechanism comprising a series of rings surrounding part of the length of said cord; a lever extending from an end one of said series of rings through the aperture in said casing wall into said guidance member; an abutment in said guidance member and a connecting element mounted in said guidance member and adapted to be attached to a harness or safety belt; said connecting element serving to maintain the lever against the abutment in said guidance member in the normal unlocked position of the device and to permit said lever to move away from said abutment so as to actuate the locking mechanism in the event of locking of the device being required.

* * * * *